US009158267B2

(12) United States Patent
Kuwabara et al.

(10) Patent No.: US 9,158,267 B2
(45) Date of Patent: Oct. 13, 2015

(54) WASTE-TONER CONVEYANCE DEVICE AND IMAGE FORMING APPARATUS

(71) Applicant: Ricoh Company, Ltd., Ohta-ku, Tokyo (JP)

(72) Inventors: Nobuo Kuwabara, Kanagawa (JP); Shinichi Kawahara, Tokyo (JP); Norio Kudoh, Kanagawa (JP); Takeshi Shintani, Kanagawa (JP); Kenji Honjoh, Kanagawa (JP); Yasuhito Kuboshima, Tokyo (JP); Yusuke Ishizuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/476,012

(22) Filed: Sep. 3, 2014

(65) Prior Publication Data

US 2015/0078795 A1 Mar. 19, 2015

(30) Foreign Application Priority Data

Sep. 17, 2013 (JP) ..... 2013-191341

(51) Int. Cl.
*G03G 21/00* (2006.01)
*G03G 21/10* (2006.01)
*G03G 21/12* (2006.01)

(52) U.S. Cl.
CPC ..... *G03G 21/105* (2013.01); *G03G 21/10* (2013.01); *G03G 21/12* (2013.01); *G03G 2215/0129* (2013.01)

(58) Field of Classification Search
CPC ..... G03G 21/105; G03G 21/12; G03G 21/10
See application file for complete search history.

(56) References Cited

U.S. PATENT DOCUMENTS

| | | | | |
|---|---|---|---|---|
| 2005/0249533 | A1 | 11/2005 | Suda et al. | |
| 2009/0074434 | A1 * | 3/2009 | Ishii | 399/35 |
| 2011/0052225 | A1 | 3/2011 | Honjoh et al. | |
| 2011/0091227 | A1 | 4/2011 | Tomita et al. | |
| 2012/0107004 | A1 | 5/2012 | Sonohara et al. | |
| 2012/0134696 | A1 | 5/2012 | Kobayashi et al. | |
| 2012/0195664 | A1 | 8/2012 | Kuwabara et al. | |

(Continued)

FOREIGN PATENT DOCUMENTS

| | | |
|---|---|---|
| JP | 2006-251114 | 9/2006 |
| JP | 2008-256921 | 10/2008 |
| JP | 2010-224004 | 10/2010 |

*Primary Examiner* — David Gray
*Assistant Examiner* — Michael Harrison
(74) *Attorney, Agent, or Firm* — Harness, Dickey & Pierce, P.L.C.

(57) ABSTRACT

An image forming apparatus including multiple image forming units; a waste-toner container; and a waste-toner conveyance device including a common conveyance channel member disposed in an arrangement direction of the image forming units and provided with toner inlets to receive the waste toner from toner outlets of the cleaning units, communicating channel members identical in structure and respectively disposed between the toner outlets and the toner inlets of the common conveyance channel member, and a rotatable conveying member to transport the waste toner inside the common conveyance channel member linearly along a rotation axis thereof. The common conveyance channel member is shaped to equalize relative positions of each of the toner outlets and a corresponding one of the toner inlets of the common conveyance channel member among the multiple image forming units among which a distance from the toner outlet to the rotation axis differs.

8 Claims, 13 Drawing Sheets

(56) References Cited

U.S. PATENT DOCUMENTS

2013/0028619 A1 1/2013 Terao et al.
2013/0071165 A1* 3/2013 Kitamura ..... 399/358
2013/0101303 A1 4/2013 Kasai et al.
2013/0148993 A1 6/2013 Aoki et al.

* cited by examiner

WASTE-TONER CONVEYANCE DEVICE AND IMAGE FORMING APPARATUS

CROSS-REFERENCE TO RELATED APPLICATIONS

This patent application is based on and claims priority pursuant to 35 U.S.C. §119(a) to Japanese Patent Application No. 2013-191341, filed on Sep. 17, 2013, in the Japan Patent Office, the entire disclosure of which is hereby incorporated by reference herein.

BACKGROUND

1. Technical Field

Embodiments of the present invention generally relate to a tandem image forming apparatus, such as a copier, a printer, a facsimile machine, or a multifunction peripheral having at least two of copying, printing, facsimile transmission, plotting, and scanning capabilities, and a waste-toner conveyance device to transport waste toner discharged from a cleaning device in a tandem image forming apparatus.

2. Description of the Related Art

There are tandem image forming apparatuses that include four image forming units to form yellow, magenta, cyan, and black toner images, respectively, transfer the respective color toner images, and superimpose the respective color toner images on a transfer medium such as an intermediate transfer member or a sheet of recording media such as paper, thereby obtaining full-color images. Such tandem image forming apparatuses can form full-color images using at least yellow, magenta, and cyan toners (and black toner as required) and monochrome images using black toner only.

In tandem image forming apparatuses, when one or more of the four colors is not used, for example, in monochrome image formation, the image forming units of colors not used may be disengaged from the transfer medium. For example, a sheet conveyance member to transport sheets of recording media is shaped into an endless belt, and the belt is moved away from the image forming units by moving a support roller supporting the belt. This configuration can reduce operation time of the image forming units not used, thereby extending operational lives thereof.

In tandem image forming apparatuses, toner images are formed on respective latent image bearers in the image forming units. After the toner images are transferred from the latent image bearers onto the transfer medium, a cleaning unit collects toner remaining thereon. The toner thus collected is discharged as waste toner from an outlet of the cleaning unit and transported by a waste-toner conveyance device to a waste-toner container.

SUMMARY

An embodiment of the present invention provides an image forming apparatus that includes multiple image forming units, a waste-toner container to contain waste toner discharged from the image forming units, and a waste-toner conveyance device to transport the waste toner to the waste-toner container. Each of the multiple image forming units includes a latent image bearer to bear a toner image and a cleaning unit to collect the waste toner from a surface of the latent image bearer.

The waste-toner conveyance device includes a common conveyance channel member disposed in a direction in which the image forming units are arranged and provided with toner inlets to receive the waste toner from respective toner outlets of the cleaning units, communicating channel members respectively disposed between the toner outlets of the cleaning units and the toner inlets of the common conveyance channel member, and a rotatable conveying member to transport the waste toner inside the common conveyance channel member linearly along a rotation axis thereof. The communicating channel members are identical in structure. A distance from the toner outlet of the cleaning unit to the rotation axis of the conveying member differs among the multiple image forming units, and the common conveyance channel member is shaped to equalize relative positions of the toner outlet of the cleaning unit and the toner inlet of the common conveyance channel member among the multiple image forming units.

Another embodiment provides a waste-toner conveyance device installable in an image forming apparatus that includes multiple image forming units each including latent image bearers to bear toner images and cleaning units to collect waste toner from surfaces of the latent image bearers. The waste-toner conveyance device includes the common conveyance channel member, the communicating channel members, and the rotatable conveying member described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
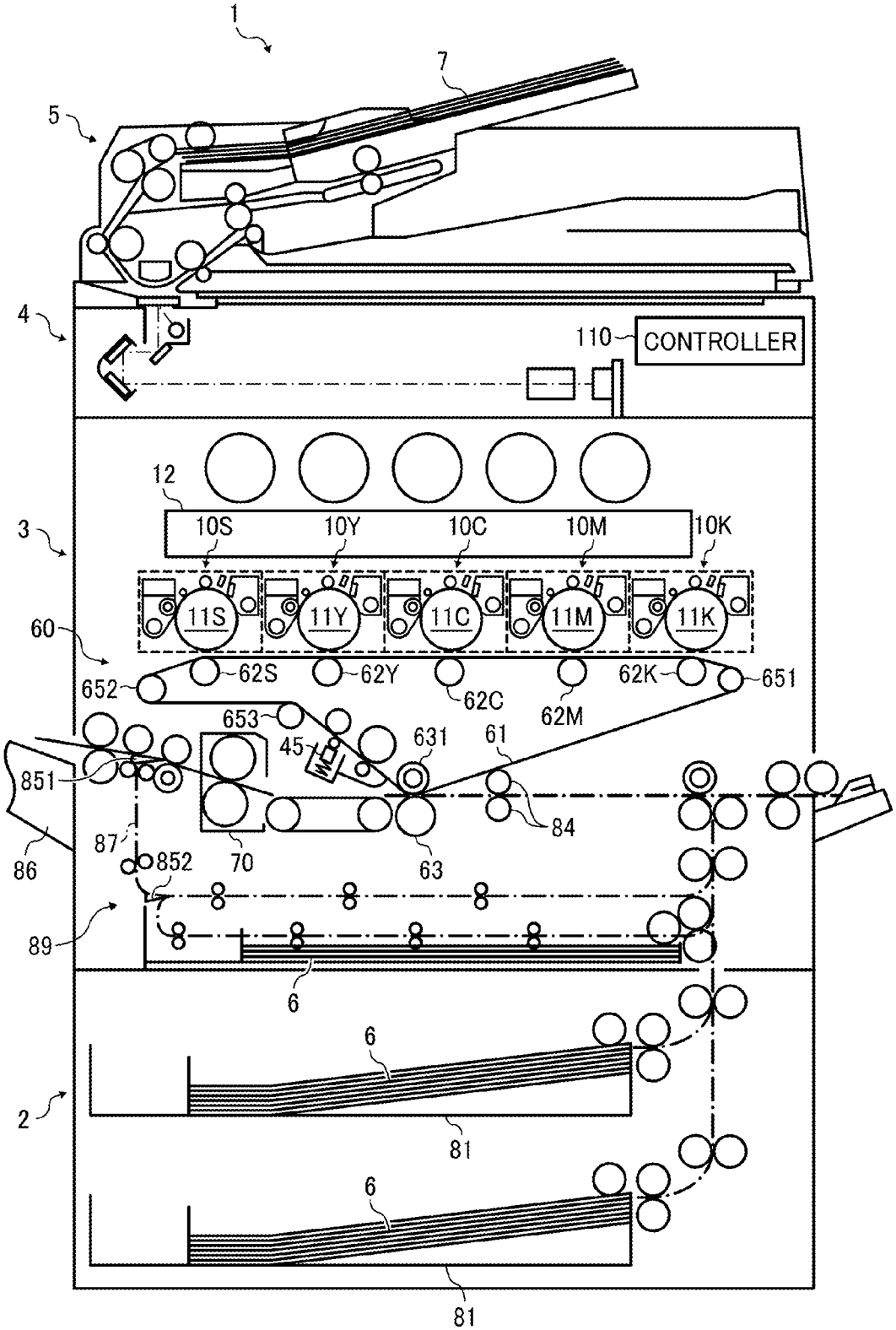
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

Figure 2:
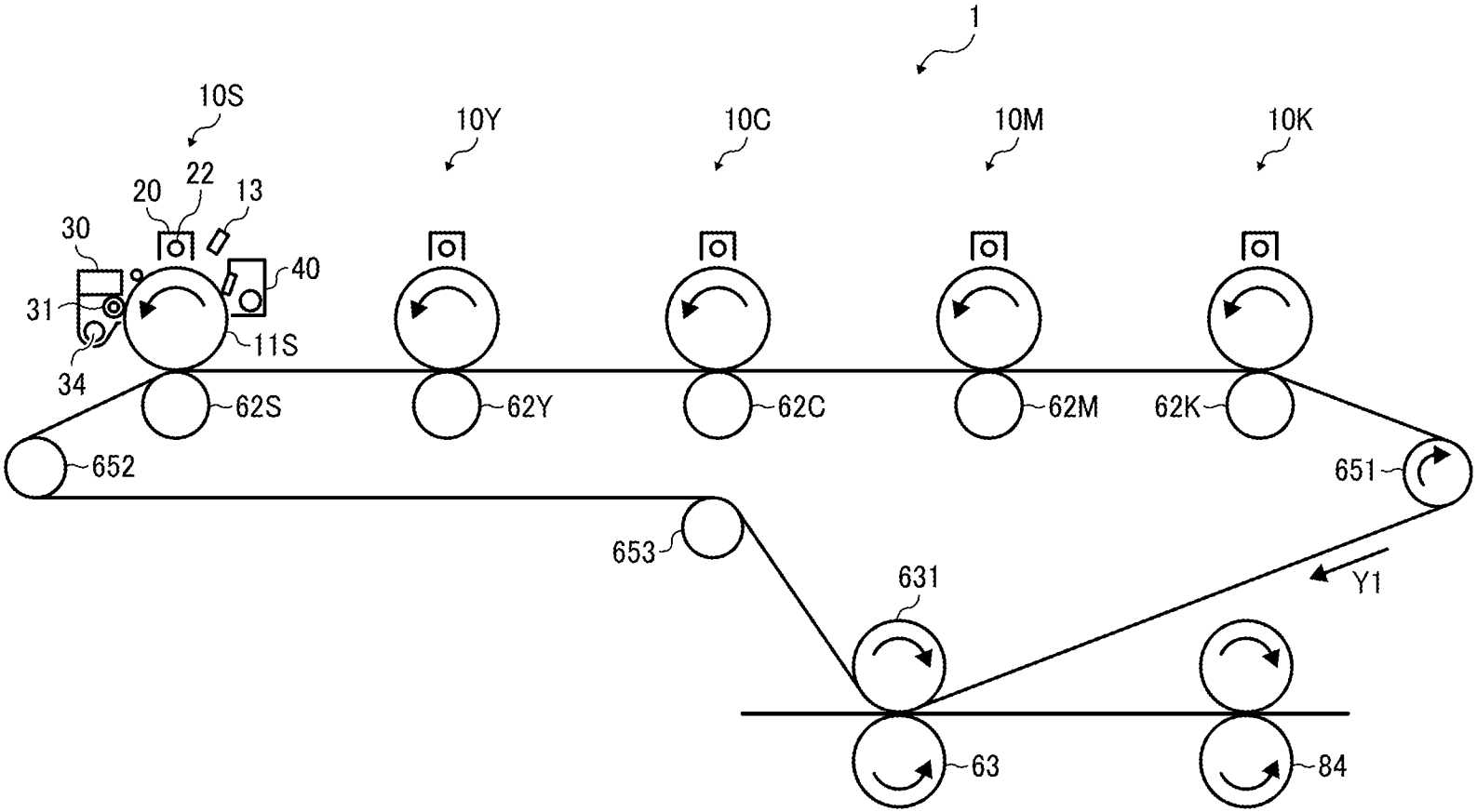
FIG. 2 is a schematic view illustrating a configuration of an image forming unit of the image forming apparatus shown in FIG. 1.

FIG. 1 is a schematic entire view of an image forming apparatus according to the present embodiment. FIG. 2 is a schematic view illustrating a configuration of an image forming unit of the image forming apparatus shown in FIG. 1.

An image forming apparatus 1 shown in FIG. 1 includes image forming units 10 arranged in parallel, usable as process cartridges removably installed in the image forming apparatus 1. In the image forming apparatus 1, different color images are superimposed one on another on an intermediate transfer belt 61 serving as an intermediate transfer member, and the superimposed images are transferred onto a recording sheet 6 serving as a recording medium at a time. As shown in FIG. 1, the image forming apparatus 1 includes an automatic document feeder (ADF) 5 to automatically transport an original 7 (e.g., an original document), a scanner 4 (i.e., a reading device) to read image data of the original 7, an image forming engine 3 to form toner images, and a sheet feeding unit 2 to contain and feed the recording sheet 6 to the image forming engine 3.

The image forming engine 3 is disposed in a center portion of the image forming apparatus 1 and has a tandem structure. In a substantially center portion therein, four image forming units 10Y, 10C, 10M, and 10K respectively corresponding to colored toner, namely, yellow (Y), cyan (C), magenta (M), and black (K) toners, and an image forming unit 10S corresponding to transparent toner (S), which may be called "clear toner", are arranged in parallel in a substantially horizontal direction. When colored toner images of yellow, cyan, magenta, and black are covered with transparent toner, an overcoat of transparent toner can protect a surface of the colored toner image. Additionally, a pattern of transparent toner on a smooth sheet can give a texture like special paper or fancy paper. It is to be noted that the order of transparent toner and colored toner in image formation is not limited to the description above.

An exposure device 12 disposed above the five image forming units 10 (10S, 10Y, 10C, 10M, and 10K) exposes surfaces of photoreceptors 11S, 11Y, 11C, 11M, and 11K of the image forming units 10 with exposure light such as laser beams according to respective color image data, thereby forming latent images thereon. Thus, the exposure device 12 serves as a latent image forming unit. A transfer device 60 disposed beneath the five image forming units 10 includes the endless intermediate transfer belt 61 that rotates in a state looped around a driving roller 651, a tension roller 652, an outer roller 653, and the like. It is to be noted that the image forming units 10S, 10Y, 10C, 10M, and 10K have a similar configuration, and thus the suffixes S, Y, M, C, and K for discrimination of the color of toner may be omitted in descriptions below.

In each image forming unit 10, around the photoreceptor 11, a charging device 20 to uniformly charge the surface of the photoreceptor 11, a developing device 30 to develop the latent image on the photoreceptor 11 into a toner image, a cleaning unit 40, and the like are provided. The cleaning unit 40 includes a cleaning blade to collect toner (i.e., untransferred toner) remaining on the surface of the photoreceptor 11 after a transfer process and clean the surface of the photoreceptor 11.

The charging device 20 can be provided with a charging roller 22 including, as a charging member, an elastic layer of moderate resistance overlying an outer circumference of a metal core. The charging roller 22 is electrically connected to a power source that applies a predetermined or desirable charging bias to the charging roller 22. The charging roller 22 is disposed across a minute clearance from the photoreceptor 11. For example, the minute clearance can be secured by winding a spacer uniform in thickness around a non-image area at either axial end of the charging roller 22 so that a surface of the spacer contacts the photoreceptor 11. Alternatively, the charging roller 22 may be disposed in contact with the photoreceptor 11.

The developing device 30 employs two-component developer including magnetic carrier and toner (hereinafter simply "developer"). The developing device 30 is disposed facing the photoreceptor 11 to develop the latent image thereon. The developing device 30 includes a developing roller 31 serving as a developer bearer, inside which a magnetic field generator is provided. Beneath the developing roller 31, a conveying screw 34 is provided to scoop developer onto the developing roller 31 while mixing developer with toner supplied from a toner bottle. The developing roller 31 transports developer to a position facing the photoreceptor 11 after a developer regulator adjusts the thickness of a layer of developer on the developing roller 31.

The cleaning unit 40 includes the cleaning blade and a holder to hold the cleaning blade. The cleaning blade is pressed against the photoreceptor 11, thereby removing unnecessary toner (e.g., waste toner). The waste toner is then collected in the cleaning unit 40 and discharged through a toner outlet 41 provided in the cleaning unit 40. The waste toner discharged from the cleaning unit 40 is transported by a waste-toner conveyance device 90 described later to a waste-toner container 100 and stored therein.

The transfer device 60 includes the endless intermediate transfer belt 61 that rotates in the state looped around the driving roller 651, the tension roller 652, and the outer roller 653 (i.e., support rollers), primary-transfer rollers 62 to primarily transfer the toner images from the photoreceptors 11 onto the intermediate transfer belt 61, a secondary-transfer roller 63 to transfer the toner image from the intermediate transfer belt 61 onto the recording sheet 6, and a roller 631 facing the secondary-transfer roller 63. The primary-transfer rollers 62 are respectively disposed facing the photoreceptors 11 across the intermediate transfer belt 61. Each primary-transfer roller 62 is electrically connected to a power source and receives a predetermined primary-transfer bias. The secondary-transfer roller 63 secondarily transfers the toner image from the intermediate transfer belt 61 onto the recording sheet 6 (i.e., a secondary-transfer process). Similarly to the primary-transfer rollers 62, the secondary-transfer roller 63 is electrically connected to a power source and receives a predetermined secondary-transfer bias. Additionally, a belt cleaning unit 64 is provided to clean the surface of the intermediate transfer belt 61 after the secondary-transfer process. The image forming apparatus 1 further includes a lubrication device 45 to lubricate the intermediate transfer belt 61. It is to be noted that, similar lubrication devices may be provided to the photoreceptors 11.

In the present embodiment, the image forming apparatus 1 is further provided with a shifting unit to change the positions of the respective photoreceptors 11 of the image forming units 10 relative to the intermediate transfer belt 61 between positions in contact with the photoreceptors 11 and positions disengaged therefrom. The shifting unit in the present embodiment moves the primary-transfer roller 62 supporting the intermediate transfer belt 61 from an inner circumferential side away from the corresponding photoreceptor 11.

On the left of the transfer device 60 in FIG. 1, a fixing device 70 to fix the toner image on the recording sheet 6 is provided. The fixing device 70 includes a fixing roller inside which a halogen heater is provided and a pressure roller to press against the fixing roller. A controller 110 controls the fixing device 70 to operate under suitable fixing conditions according to image formation type (i.e., operation mode) such as full-color image formation, monochrome image formation, single-side printing, and double-side printing as well as sheet type.

When double-side copying or double-side printing is selected, the recording sheet 6 is guided by a switching pawl 851 to a sheet reversal unit 89 after an image is fixed on one side of the recording sheet 6. Then, the recording sheet 6 is reversed upside down while transported in reciprocation along a reversal conveyance channel 87 defined by multiple conveyance rollers and sheet guides disposed at predetermined positions. Then, the recording sheet 6 is guided back to a conveyance channel for image formation by a switching pawl 852 and transported again to registration rollers 84.

Image forming operation of the image forming apparatus 1 in the present embodiment is described below.

Controlled by the controller 110 according to the image formation type, the shifting unit causes the photoreceptor 11 of the image forming unit 10 used in image formation to contact the intermediate transfer belt 61 and disengage that of the image forming unit 10 not used from the intermediate transfer belt 61. The photoreceptor 11 in contact with the intermediate transfer belt 61 rotates counterclockwise in the drawing, driven by a driving unit. The charging device 20 uniformly charges, to a predetermined polarity, the surface of the photoreceptor 11 that is rotating. The exposure device 12 directs the laser beam to the surface of the photoreceptor 11 thus charged to form an electrostatic latent image thereon. The developing device 30 supplies the corresponding color toners to the electrostatic latent image, thereby developing it into a toner image.

As the photoreceptors 11 rotate, the intermediate transfer belt 61 rotate clockwise in the drawing. With actions of the primary-transfer rollers 62, the color toner images are primarily transferred from the photoreceptors 11 and superimposed one on another on the intermediate transfer belt 61. After the toner image is transferred therefrom, toner remaining on the surface of the photoreceptor 11 is collected by the cleaning unit 40 and transported to the waste-toner container 100 by the waste-toner conveyance device 90 described later. Additionally, a discharger 13 initializes potential on the surface of the photoreceptor 11 as a preparation for subsequent image formation.

Meanwhile, the recording sheet 6 is fed from a sheet feeding tray 81 and forwarded by the registration rollers 84 to a secondary-transfer position, timed to coincide with the toner image on the intermediate transfer belt 61. With actions of the secondary-transfer roller 63, the toner image is secondarily transferred from the intermediate transfer belt 61 onto the recording sheet 6 at a time. After the secondary-transfer process, the recording sheet 6 is transported to the fixing device 70. While the recording sheet 6 passes through the fixing device 70, the toner image is fixed thereon with heat and pressure. After the toner image is fixed thereon, the recording sheet 6 is discharged to a discharge tray 86.

The image forming apparatus 1 according to the present embodiment is capable of three different operations (modes) of full-color image formation, monochrome image formation, and special image formation.

Figure 3:
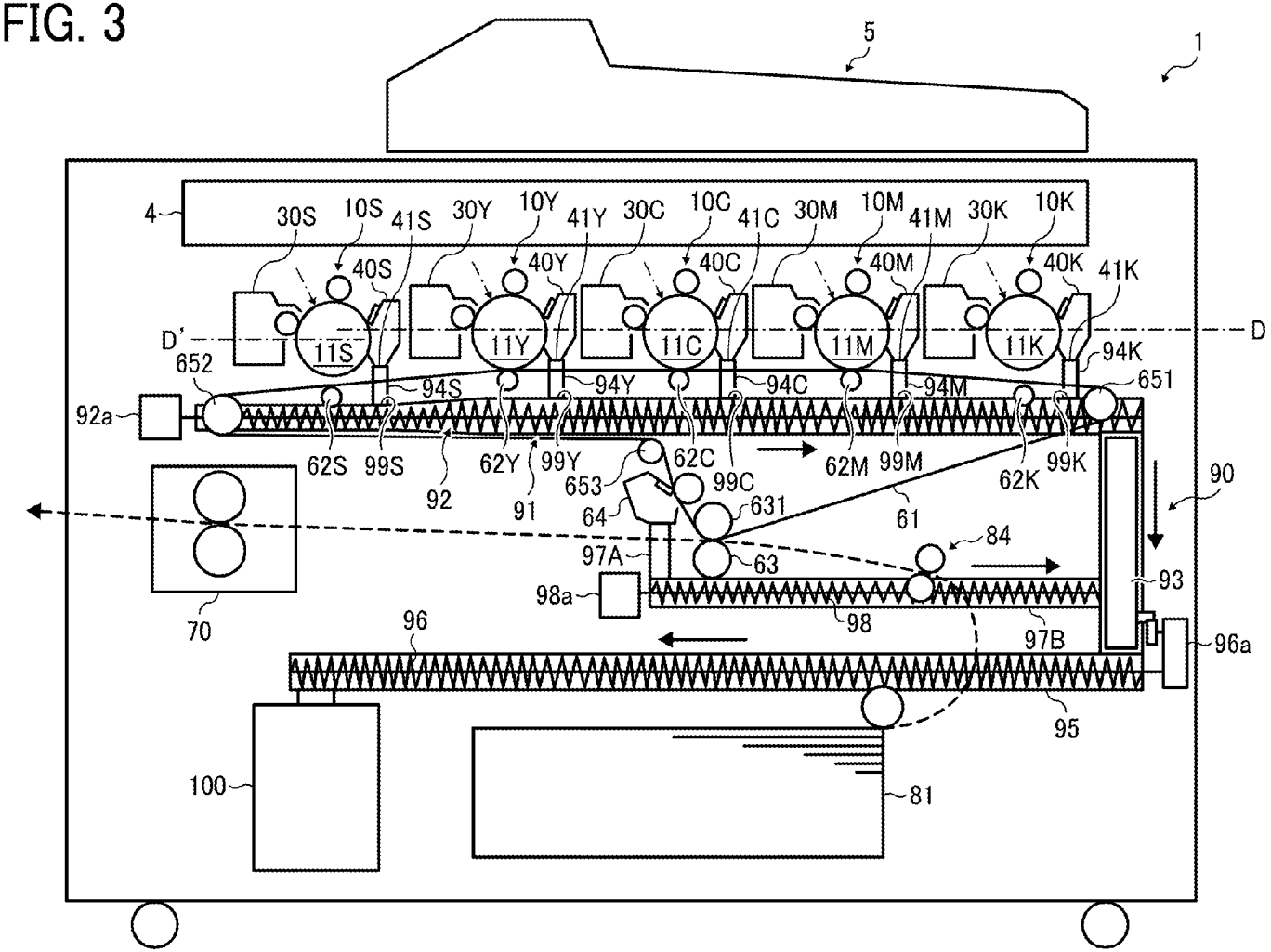
FIG. 3 illustrates relative positions of an intermediate transfer belt and photoreceptors in full-color image formation in the image forming apparatus shown in FIG. 1.

Full-color image formation is to form full-color images using yellow, magenta, and cyan toners. In full-color image formation, as shown in FIG. 3, the primary-transfer rollers 62Y, 62C, and 62M are positioned adjacent to the photoreceptors 11Y, 11C, and 11M so that the intermediate transfer belt 61 contacts the photoreceptors 11Y, 11C, and 11M.

By contrast, the image forming units 10S and 10K are not used in full-color image formation according to the present embodiment, and the primary-transfer rollers 62S and 62K are positioned away from the photoreceptors 11S and 11K. Then, the intermediate transfer belt 61 is stretched flat in a portion between the tension roller 652 and the primary-transfer roller 62Y respectively upstream and downstream from the primary-transfer roller 62S in the direction indicated by arrow Y1 in FIG. 2, in which the intermediate transfer belt 61 rotates (hereinafter "belt conveyance direction Y1"), and the intermediate transfer belt 61 is disengaged from the photoreceptor 11S. The intermediate transfer belt 61 becomes flat similarly in a portion stretched between the primary-transfer roller 62M and the driving roller 651 respectively upstream and downstream from the primary-transfer roller 62K in the belt conveyance direction Y1, and the intermediate transfer belt 61 is disengaged from the photoreceptor 11K.

Figure 4:
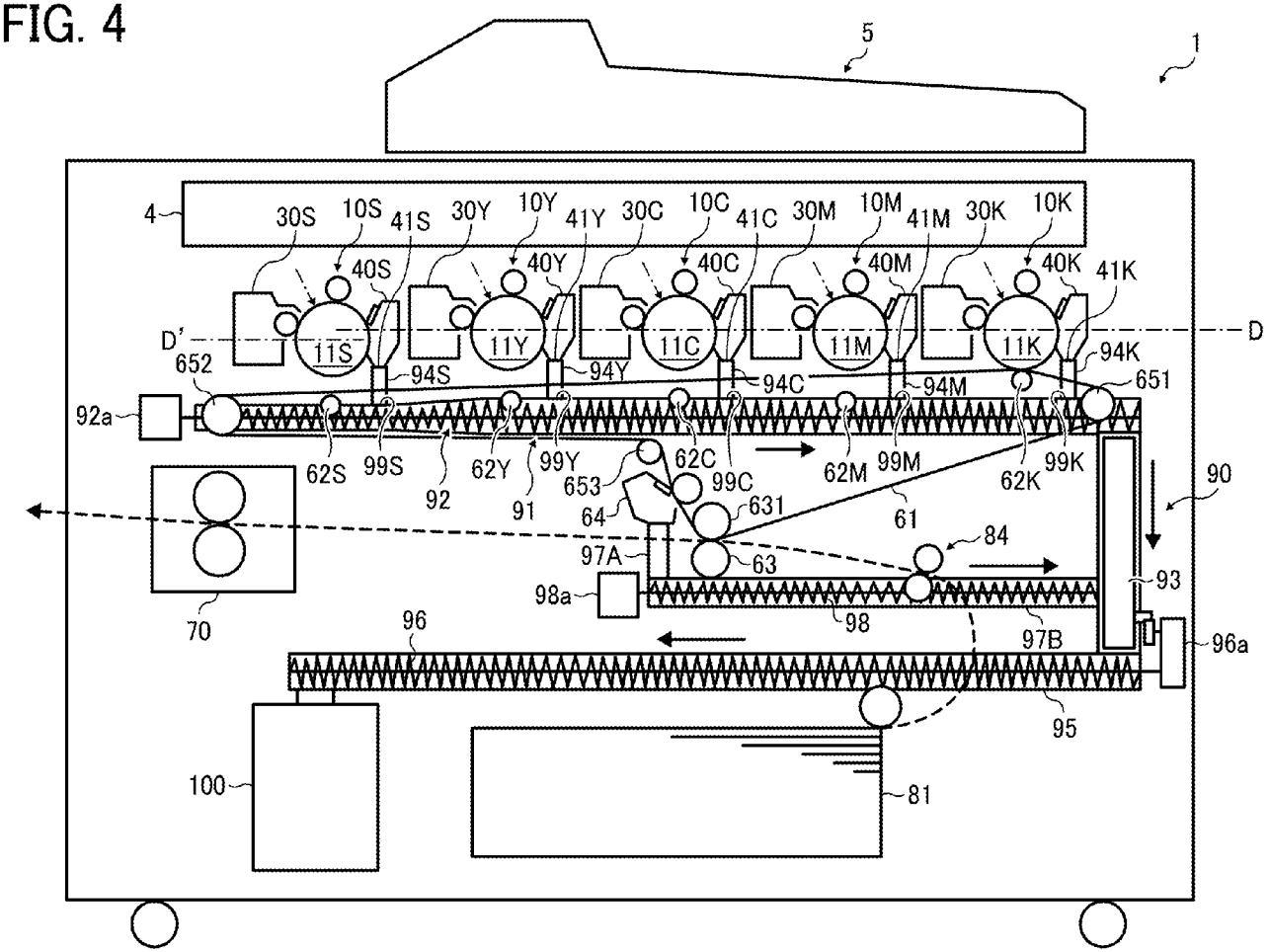
FIG. 4 illustrates the relative positions of the intermediate transfer belt and the photoreceptors in monochrome image formation in the image forming apparatus shown in FIG. 1.

Monochrome image formation is to form images using black toner. In monochrome image formation, as shown in FIG. 4, the primary-transfer roller 62K is positioned adjacent to the photoreceptor 11K so that the intermediate transfer belt 61 contacts the photoreceptor 11K. By contrast, the image forming units 10S, 10Y, 10M, and 10C are not used in monochrome image formation, and the primary-transfer rollers 62S, 62Y, 62M, and 62C are positioned away from the corresponding photoreceptors 11. Then, the intermediate transfer belt 61 is stretched flat in a portion between the tension roller 652, upstream from the primary-transfer roller 62S in the direction indicated by arrow Y1 in FIG. 2, and the primary-transfer roller 62K, and the intermediate transfer belt 61 is disengaged from the photoreceptors 11S, 11Y, 11M, and 11C.

Figure 5:
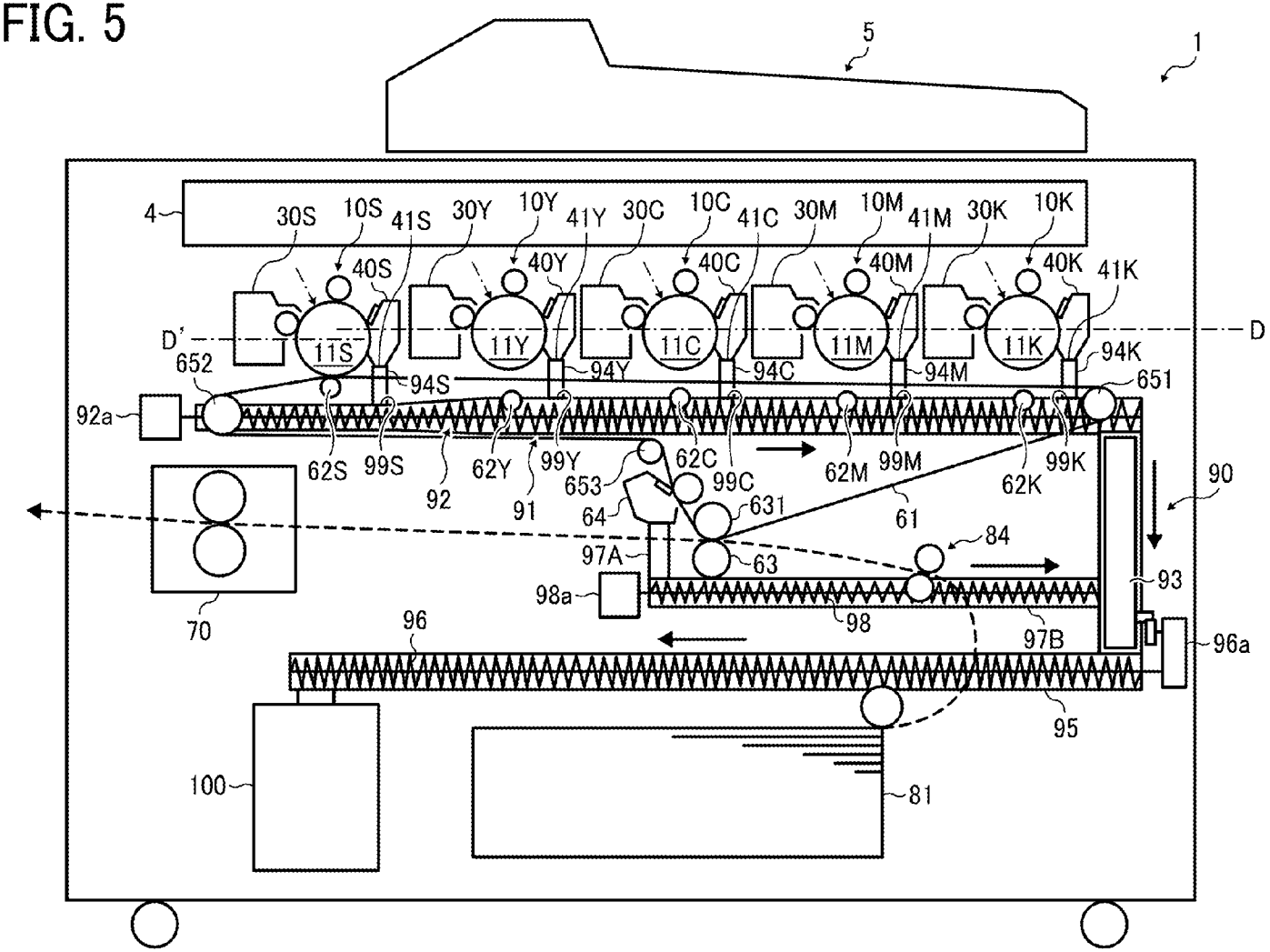
FIG. 5 illustrates the relative positions of the intermediate transfer belt and the photoreceptors in special image formation in the image forming apparatus shown in FIG. 1.

Special image formation is to form images using special toner. In special image formation, as shown in FIG. 5, the primary-transfer roller 62S is positioned adjacent to the photoreceptor 11S so that the intermediate transfer belt 61 contacts the photoreceptor 11S. By contrast, the image forming units 10Y, 10M, 10C, and 10K are not used in special image formation, and the primary-transfer rollers 62Y, 62M, 62C, and 62K are positioned away from the corresponding photoreceptors 11. Then, the intermediate transfer belt 61 is stretched flat in a portion between the primary-transfer roller 62S and the driving roller 651 downstream from the primary-transfer roller 62K in the direction indicated by arrow Y1 in FIG. 2, and the intermediate transfer belt 61 is disengaged from the photoreceptors 11Y, 11M, 11C, and 11K.

Next, descriptions are given below of waste-toner conveyance devices in tandem image forming apparatuses according to comparative examples.

It is disadvantageous in terms of cost and space that the waste-toner conveyance device transports the waste toner collected by the respective cleaning units through individual conveyance channels to the waste-toner container. Therefore, the waste-toner conveyance device typically includes a common conveyance channel common to the respective toners, disposed adjacent to the respective cleaning units. The waste-toner conveyance device collects waste toner discharged from the respective cleaning units to the common conveyance channel via communicating channels connecting the common conveyance channel with the respective cleaning units.

In such waste-toner conveyance devices, a rotatable conveying member such as a conveying screw transports waste toner linearly and axially in the conveyance channel. In tandem image forming apparatuses, generally, the respective image forming units are arranged linearly, and the cleaning units thereof are arranged linearly. Accordingly, disposing the common conveyance channel along the direction of arrangement of the cleaning units can equalize distances between respective toner outlets of the cleaning units and the common conveyance channel (in particular, distances between the toner outlets of the cleaning units and a rotation axis of the conveying member in the common conveyance channel). In this case, since the communicating channels connecting the respective toner outlets of the cleaning units to the common conveyance channel can be identical or similar in length, common components can be used for the communicating channels.

Figure 13:
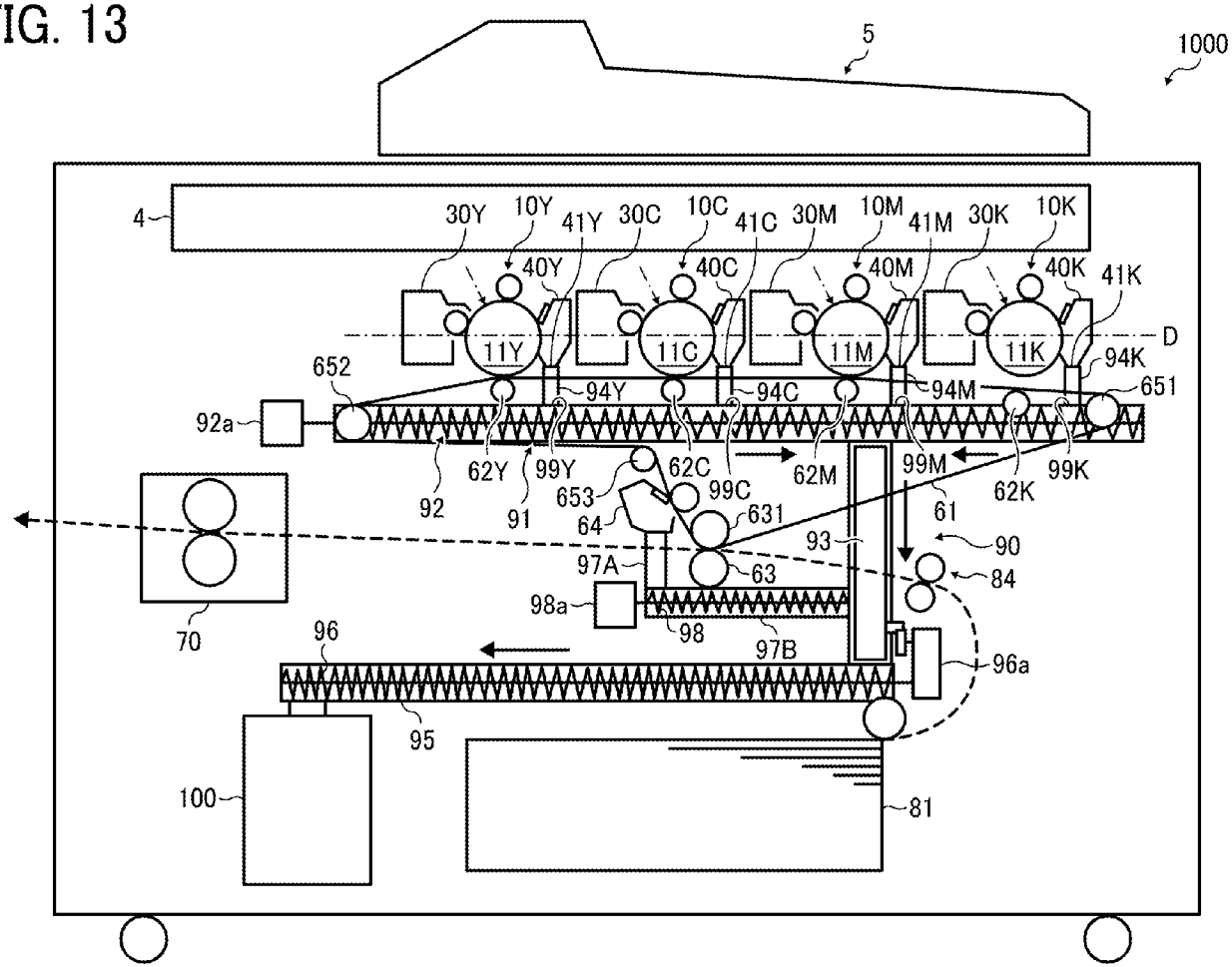
FIG. 13 is a schematic diagram of a comparative image forming apparatus including four image forming units corresponding to yellow, magenta, cyan, and black, in a state for full-color image formation.

FIG. 13 is a schematic diagram of a tandem image forming apparatus 1000 according to a comparative example, in a state for full-color image formation.

Figure 14:
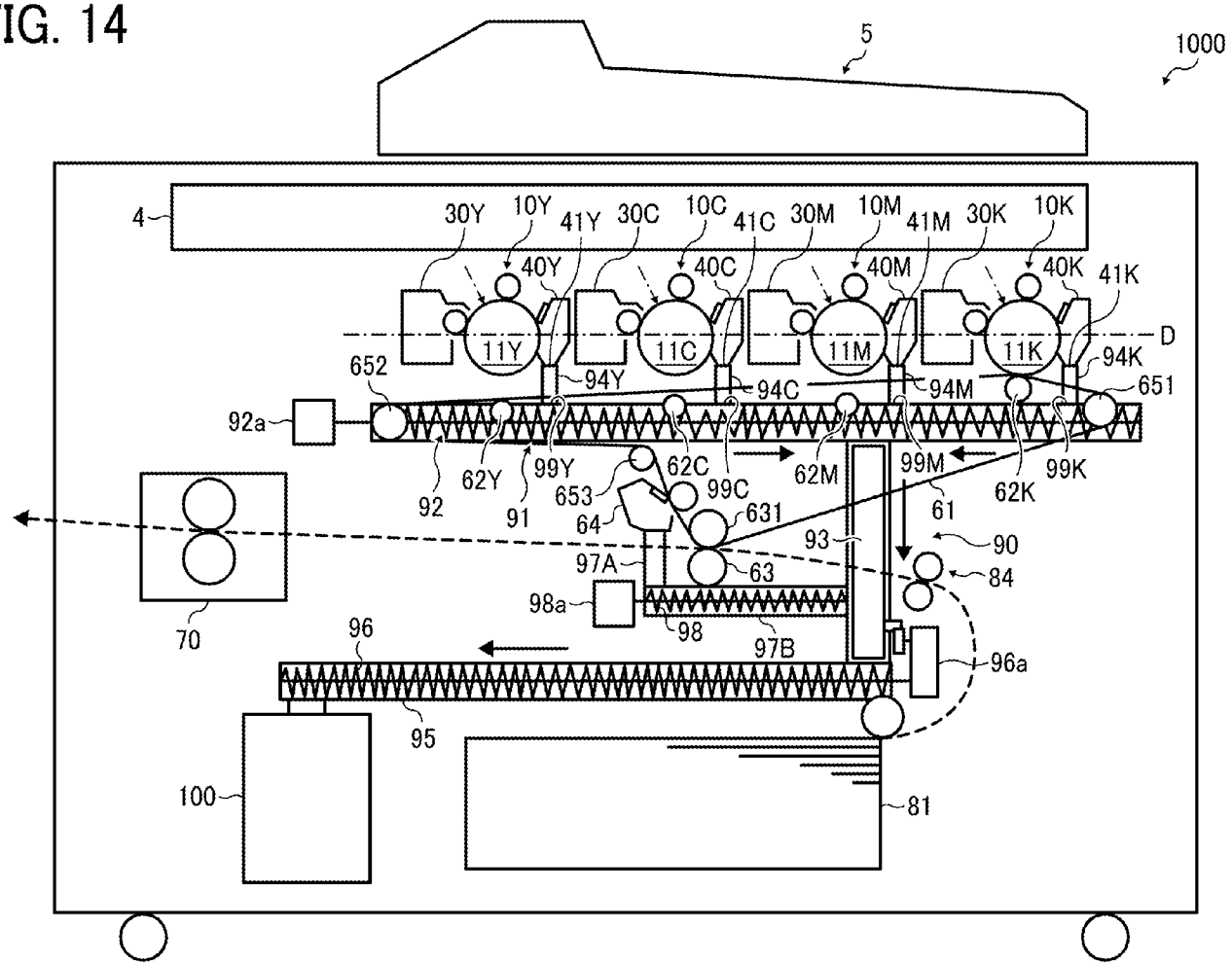
FIG. 14 is a schematic diagram of the image forming apparatus shown in FIG. 13, in a state for monochrome image formation.

FIG. 14 is a schematic diagram of the image forming apparatus 1000 in a state for monochrome image formation.

The components of the image forming apparatus 1000 shown in FIGS. 13 and 14 similar to those of the image forming apparatus 1 shown in FIG. 1 are given identical reference numerals, and the descriptions thereof are simplified.

The tandem image forming apparatus 1000, shown in FIGS. 13 and 14, includes the four image forming units 10Y, 10M, 10C, and 10K corresponding to yellow, magenta, cyan, and black (hereinafter "quadruple tandem image forming apparatus") and primarily transfers respective color toner images from the photoreceptors 11Y, 11M, 11C, and 11K onto the intermediate transfer belt 61 and then secondarily transfers these images onto a recording sheet 6. In the image forming apparatus 1000, the image forming units 10Y, 10M, 10C, and 10K are linearly arranged in that order in the direction in which the intermediate transfer belt 61 rotates, and the cleaning units 40Y, 40M, 40C, and 40K of the respective image forming units 10 are arranged linearly as well. Additionally, a common conveying pipe 91 is disposed linearly along the direction in which the cleaning units 40Y, 40M, 40C, and 40K are arranged, and the toner outlets 41 of the respective cleaning units 40 are connected to the common conveying pipe 91 by communicating pipes 94 common in components.

In the quadruple tandem image forming apparatus 1000 shown in FIGS. 13 and 14, in full-color image formation, the image forming unit 10K is not used, and the primary-transfer roller 62K is moved away from the image forming unit 10K. With this action, a portion of the intermediate transfer belt 61 facing the primary-transfer roller 62K, which has been pushed to an outer circumferential side of the intermediate transfer belt 61 and in contact with the photoreceptor 11K, is stretched flat between the primary-transfer roller 62C, adjacent to and upstream from the primary-transfer roller 62K in the belt conveyance direction, and the driving roller 651. Consequently, the intermediate transfer belt 61 is disengaged from the photoreceptor 11K as shown in FIG. 13.

By contrast, in monochrome image formation, the image forming units 10Y, 10M, and 10C are not used, and the primary-transfer rollers 62Y, 62M, and 62C are moved away from the corresponding image forming units 10. With this action, a portion of the intermediate transfer belt 61 facing the primary-transfer rollers 62Y, 62M, and 62C, which has been pushed to the outer circumferential side of the intermediate transfer belt 61 and in contact with the photoreceptors 11Y, 11M, and 11C, is stretched flat between a portion facing the tension roller 652 (on the left in FIG. 13), upstream from the primary-transfer roller 62Y in the belt conveyance direction, and the primary-transfer roller 62K, adjacent to and downstream from the primary-transfer roller 62C. Consequently, the intermediate transfer belt 61 is disengaged from the photoreceptors 11Y, 11M, and 11C as shown in FIG. 14.

Further, there are tandem image forming apparatuses including an image forming unit employing special toner such as white toner and transparent toner, in addition to those employing to yellow, magenta, cyan, and black (hereinafter "quintuple tandem image forming apparatuses). The inventors of the present invention have found that, in special image formation using special toner only, it may be difficult to sufficiently disengage the photoreceptors of the image forming unit not used from the intermediate transfer member or the recording medium.

Figure 15:
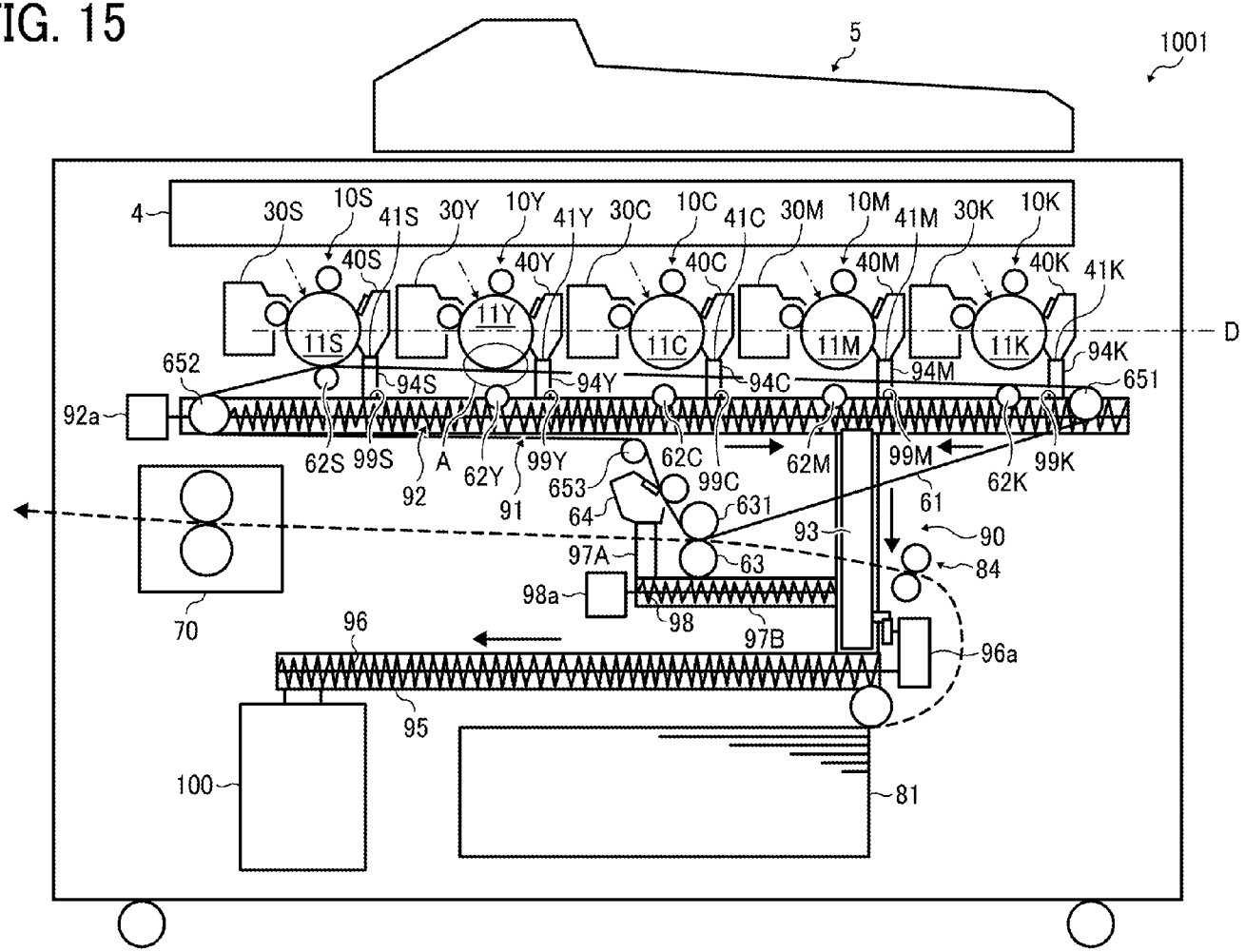
FIG. 15 is a schematic diagram of another comparative image forming apparatus that includes five image forming units, in a state for special image formation.

FIG. 15 is a schematic diagram of another comparative image forming apparatus 1001, which employs special toner in addition to yellow, magenta, cyan, and black toners. The state shown in FIG. 15 is for special image formation.

The components of the image forming apparatus 1001 shown in FIG. 15 similar to those of the image forming apparatus 1 shown in FIG. 1 and the image forming apparatus 1001 shown in FIG. 13 are given identical reference numerals, and the descriptions thereof are simplified.

In the quintuple tandem image forming apparatus 1001, the image forming units 10S, 10Y, 10M, 10C, and 10K are linearly arranged in that order in the direction in which the intermediate transfer belt 61 rotates, and the cleaning units 40S, 40Y, 40M, 40C, and 40K of the respective image forming units 10 are arranged linearly as well. The toner outlets 41S, 41Y, 41M, 41C, and 41K of the respective cleaning units 40 are connected to the common conveying pipe 91 by the communicating pipes 94S, 94Y, 94M, 94C, and 94K made of channel forming members common to respective toners.

In the quintuple tandem image forming apparatus 1001, in special image formation using the image forming unit 10S only, the primary-transfer rollers 62Y, 62M, 62C, and 62K are moved away from the corresponding image forming units 10Y, 10M, 10C, and 10K. With this action, as shown in FIG. 15, a portion of the intermediate transfer belt 61 facing the primary-transfer rollers 62Y, 62M, 62C, and 62K, which has been pushed to the outer circumferential side of the intermediate transfer belt 61 and in contact with the photoreceptors 11Y, 11M, 11C, and 11K, is stretched flat between the primary-transfer roller 62S, adjacent to and upstream from the primary-transfer roller 62Y in the belt conveyance direction, and the driving roller 651, adjacent to and downstream from the primary-transfer roller 62K.

In special image formation, similarly to monochrome image formation in the quadruple tandem image forming apparatus 1000 shown in FIG. 14, only the image forming unit 10S at the end in the arrangement of the image forming units 10 contacts the intermediate transfer belt 61, and the rest are disengaged from the intermediate transfer belt 61. At that time, compared with the quadruple tandem image forming apparatus 1000 shown in FIG. 14, a greater number of the image forming units 10 are disengaged from the intermediate transfer belt 61 in the quintuple tandem image forming apparatus 1001 shown in FIG. 15, and accordingly the flat portion of the intermediate transfer belt 61 disengaged from those image forming units 10 is longer. Accordingly, in special image formation in the quintuple tandem image forming apparatus 1001, an inclination of the surface of the intermediate transfer belt 61 stretched flat between the primary-transfer roller 62S and the driving roller 651 at the right end in FIG. 15 relative to the direction of arrangement of the special image formation is smaller than that in monochrome image formation in the quadruple tandem image forming apparatus 1000. As a result, in special image formation in the quintuple tandem image forming apparatus 1001, as indicated with oval A shown in FIG. 15, the distance between the photoreceptor 11Y, adjacent to the photoreceptor 11S in contact with the intermediate transfer belt 61, and the intermediate transfer belt 61 may be insufficient. Then, the photoreceptor 11Y can contact the intermediate transfer belt 61. If the photoreceptor 11Y contacts the intermediate transfer belt 61, it may cause inconveniences such as damage to the photoreceptor 11Y or the intermediate transfer belt 61, changes in a surface movement velocity of the intermediate transfer belt 61 that can degrade image quality, and the like.

Figure 16:
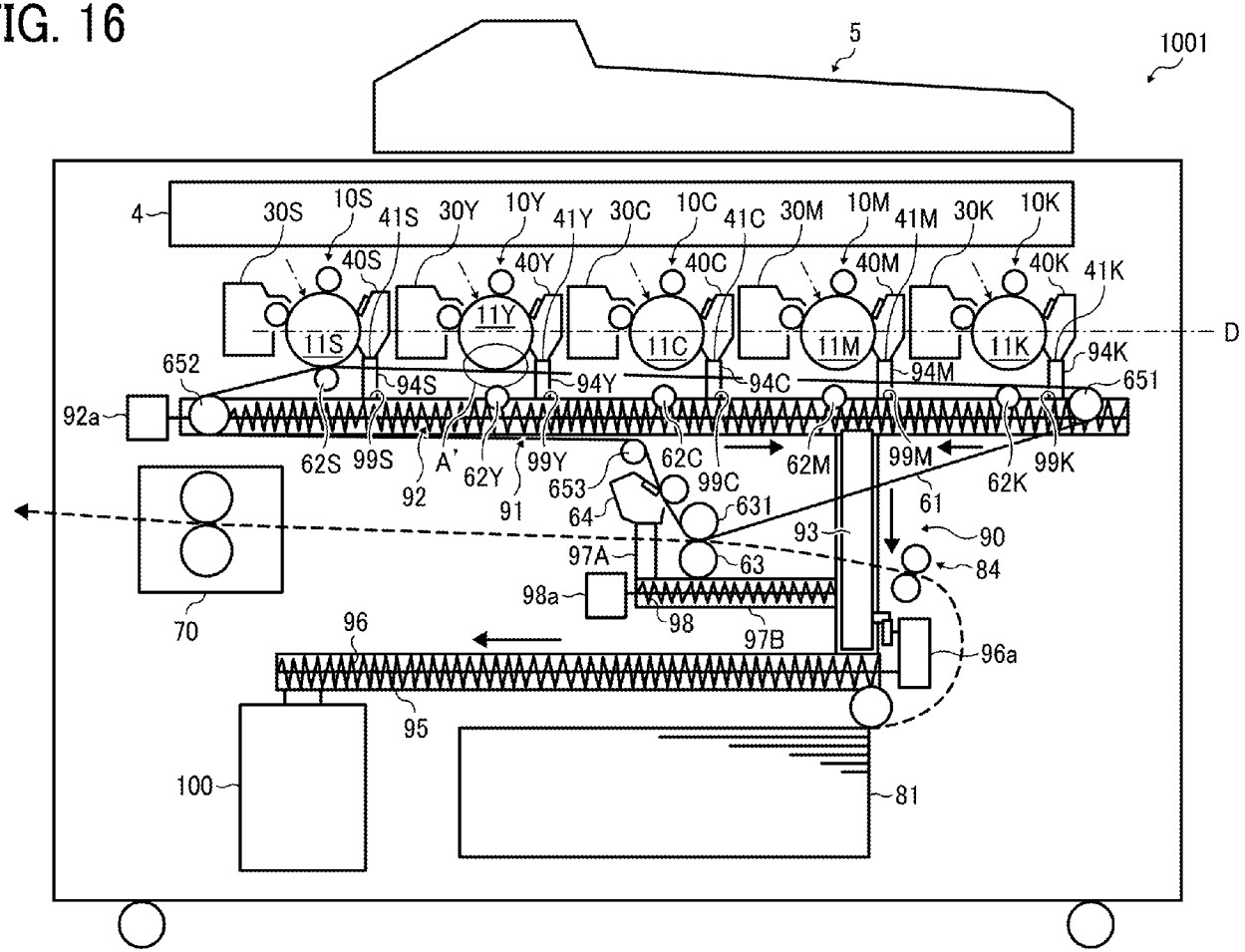
FIG. 16 is a schematic diagram illustrating a state for special image formation in the image forming apparatus shown in FIG. 15, in which the image forming unit for special toner is disposed closer to the intermediate transfer belt than other four image forming units.

FIG. 16 is a schematic diagram illustrating the image forming apparatus 1001 in which the image forming unit 10S is disposed closer to the intermediate transfer belt 61 than other four image forming units 10Y, 10M, 10C, and 10K. The state shown in FIG. 16 is for special image formation.

To inhibit the above-described inconveniences, as shown in FIG. 16, it is advantageous to dispose the image forming unit 10S closer to the intermediate transfer belt 61 than other four image forming units 10Y, 10M, 10C, and 10K. In this case, in special image formation in the quintuple tandem image forming apparatus 1001, as indicated by oval A' shown in FIG. 16, compared with the state shown in FIG. 15, the distance between the photoreceptor 11Y and the intermediate transfer belt 61 is longer, thus reducing the risk of contact between the photoreceptor 11Y and the intermediate transfer belt 61.

In the configuration shown in FIG. 16, however, the cleaning unit 40S of the image forming unit 10S is closer to the intermediate transfer belt 61 than the cleaning units 40Y, 40M, 40C, and 40K of the rest of the image forming units 10. In this case, the relative positions of the toner outlet 41 and the common conveying pipe 91 differ between the portion corresponding to the cleaning unit 40S and that corresponding to the other cleaning units 40Y, 40M, 40C, and 40K. Accordingly, components of the communicating pipes 94 between the toner outlets 41 and the common conveying pipe 91 differ among the five toners. If the component of the communicating pipe 94 of the cleaning unit 40S is different from those of other colors, it can increase the risk of erroneous assembling in addition to the cost.

It is to be noted that the above-described inconveniences can arise in configurations in which the distance between the toner outlet of the cleaning unit to the linear common conveyance channel is not identical among multiple cleaning units regardless of the reason since commonality of components is not achieved.

In view of the foregoing, descriptions are given below of a configuration of the waste-toner conveyance device 90 according to the present embodiment with reference to FIGS. 3 through 5.

In the present embodiment, waste toner, such as untransferred toner, collected by the cleaning unit 40 is discharged through the toner outlet 41 of the cleaning unit 40. Then, the waste-toner conveyance device 90 transports the waste toner to the waste-toner container 100. The waste-toner conveyance device 90 includes the common conveying pipe 91 common to the respective toners. The common conveying pipe 91 is linear and extends substantially horizontally, adjacent to the respective cleaning units 40. The waste-toner container 100 collects waste toner discharged from the respective cleaning units 40 to the common conveying pipe 91 via the communicating pipes 94 connecting the common conveying pipe 91 with the toner outlets 41 of the respective cleaning units 40.

The common conveying pipe 91 serves as a tubular common conveyance channel member and defines therein a common conveyance channel through which waste toner from the respective cleaning units 40 is transported. A conveying screw 92 provided inside the conveying pipes 94 serves as a rotatable conveying member to transport waste toner in the direction of rotation axis thereof (hereinafter "axial direction"). As a driving motor 92*a* rotates the conveying screw 92, the waste toner inside the common conveying pipe 91 is transported linearly in the axial direction thereof to a first end side (on the right in the drawing) of the common conveying pipe 91. The conveying screw 92 includes a rotation shaft 92B (shown in FIG. 7A) and a screw blade 92C (shown in FIG. 7A) provided on the rotation shaft 92B. An outer end of the screw blade 92C is positioned across a small gap from an inner face of the common conveying pipe 91.

It is to be noted that the tabular channel members that define the common conveyance channel and the communicating channels are not limited to pipes but may be tubes or the like.

An exit is provided in a bottom of the first end side (on the right in FIG. 3) of the common conveying pipe 91 to discharge waste toner from the common conveying pipe 91. On the first end side of the common conveying pipe 91, waste toner falls through the exit to a vertical conveyance channel 93. A lower end of the vertical conveyance channel 93 communicates with an upper face of a first end (a right end in FIG. 3) of a horizontal conveyance channel 95, and the waste toner falls through the vertical conveyance channel 93 to the first end of the horizontal conveyance channel 95.

Similarly to the common conveyance channel, the horizontal conveyance channel 95 is in a tubular conveying pipe, inside which a conveying screw 96 similar to the conveying screw 92 is provided. As a driving motor 96*a* rotates the conveying screw 96, the waste toner inside the horizontal conveyance channel 95 is transported linearly in the axial direction thereof to a second end side (on the left in FIG. 3) of the horizontal conveyance channel 95.

An outlet is provided in a bottom of the second end side (on the left in FIG. 3) of the horizontal conveyance channel 95 to discharge waste toner from the horizontal conveyance channel 95 downward to the waste-toner container 100. On the second end side of the horizontal conveyance channel 95, waste toner falls through the outlet to the waste-toner container 100 and stored therein.

The waste-toner conveyance device 90 according to the present embodiment transports, to the waste-toner container 100, the waste toner collected from the intermediate transfer belt 61 by the belt cleaning unit 64 as well. Specifically, the waste toner discharged from the belt cleaning unit 64 is transported from a communicating channel 97A to a second end side (on the left in FIG. 3) of a horizontal communicating channel 97B. Similarly to the common conveyance channel, the horizontal communicating channel 97B is in a tubular conveying pipe, inside which a conveying screw 98 similar to the conveying screw 92 is provided. As a driving motor 98*a* rotates the conveying screw 98, the waste toner inside the horizontal communicating channel 97B is transported linearly in the axial direction thereof to a first end side (on the right in FIG. 3) of the horizontal communicating channel 97B. The first end side (on the right in FIG. 3) of the horizontal communicating channel 97B is connected to an intermediate portion of the vertical conveyance channel 93. On the first end side of the horizontal communicating channel 97B, waste toner is introduced into the vertical conveyance channel 93 and falls to the first end of the horizontal conveyance channel 95.

With this configuration, together with the waste toner discharged from the cleaning units 40 of the respective image forming units 10, the waste toner discharged from the belt cleaning unit 64 is transported inside the horizontal conveyance channel 95 to the waste-toner container 100 and stored therein.

Each communicating pipe 94 serves as a tubular communicating member that defines therein a communication channel, through which the toner outlet 41 of the cleaning unit 40 communicates with the common conveying pipe 91. A crosslinking preventer is provided in the communicating pipe 94 to inhibit the waste toner passing through the communicating pipe 94 from remaining there and resulting in crosslinking (bridge phenomenon). There are known configurations for the crosslinking preventer.

Figure 6A:
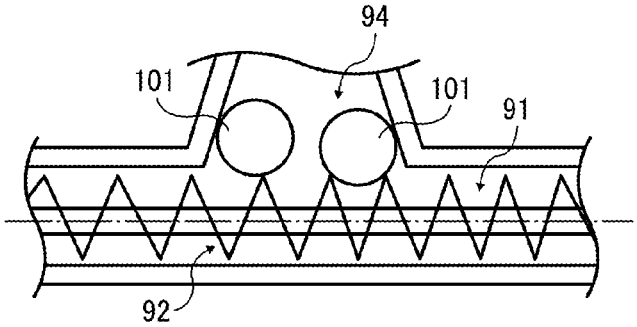
FIG. 6A illustrates a configuration of crosslinking preventers provided in communicating channels of a waste-toner conveyance device according to an embodiment, as viewed in a direction perpendicular to an axial direction of a conveying screw.
Figure 6B:
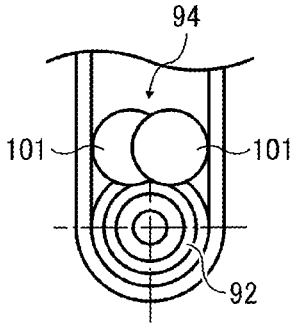
FIG. 6B is a schematic diagram of the crosslinking preventer shown in FIG. 6A, as viewed in the axial direction of the conveying screw.

For example, the crosslinking preventer can be rigid balls 101 contained in the communicating pipe 94 as shown in FIGS. 6A and 6B. In the configuration shown in FIGS. 6A and 6B, the rigid balls 101 inside the communicating pipe 94 are disposed to ride on the outer end of the screw blade 92C of the conveying screw 92. As the conveying screw 92 rotates, the rigid balls 101 move inside the communicating pipe 94, thereby inhibiting toner from remaining there and loosening toner in the state of crosslinking.

Figure 7A:
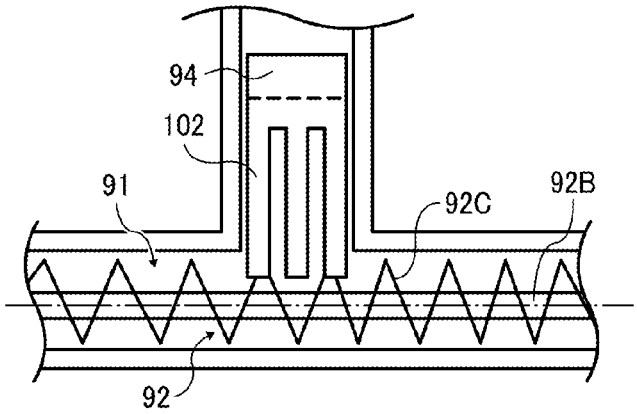
FIG. 7A illustrates another configuration of the crosslinking preventers as viewed in the direction perpendicular to the axial direction of the conveying screw.
Figure 7B:
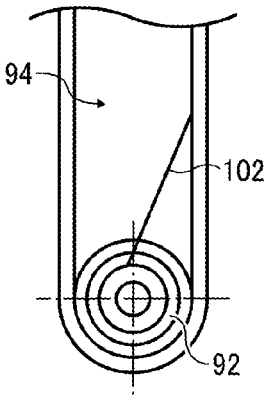
FIG. 7B is a schematic diagram of the crosslinking preventer shown in FIG. 7A, as viewed in the axial direction of the conveying screw.

Alternatively, referring to FIGS. 7A and 7B, the crosslinking preventer may be a plastic sheet 102, such as Mylar® (registered trademark of DuPont), provided in the communicating pipe 94. In this case, a first end of the plastic sheet 102 is attached to an inner wall of the communicating pipe 94, and a second end thereof contacts the outer end of the screw blade 92C of the conveying screw 92. With this configuration, as the conveying screw 92 rotates, the second end of the plastic sheet 102 moves, thereby inhibiting toner from remaining there and loosening toner in the state of crosslinking. In the present embodiment, the plastic sheet 102 is used as the crosslinking preventer to inhibit crosslinking of toner inside the communicating pipe 94.

As shown in FIGS. 3 through 5, in the image forming apparatus 1 according to the present embodiment, the image forming units 10Y, 10M, 10C, and 10K (except the image forming unit 10S) are arranged linearly in the horizontal direction. The image forming unit 10S is disposed slightly deviated from the direction of arrangement of the image forming units 10Y, 10M, 10C, and 10K.

Figure 8:
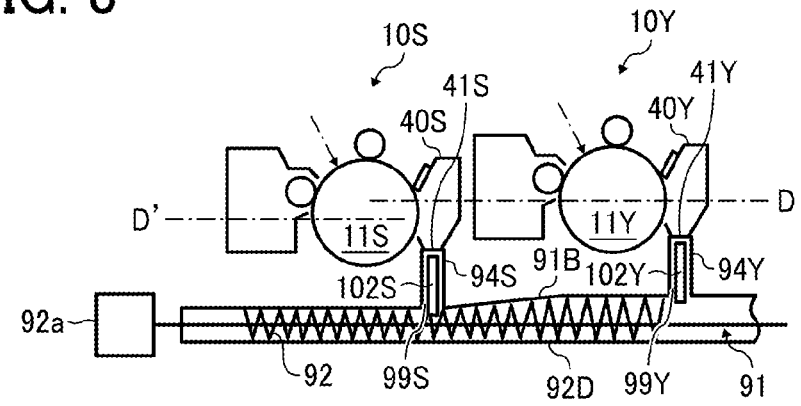
FIG. 8 is an enlarged view according to an embodiment, in which the common conveyance channel includes a tapered portion between a portion where the communicating channel for special toner is connected and a portion where the communicating channels for other color toners are connected.
Figure 9:
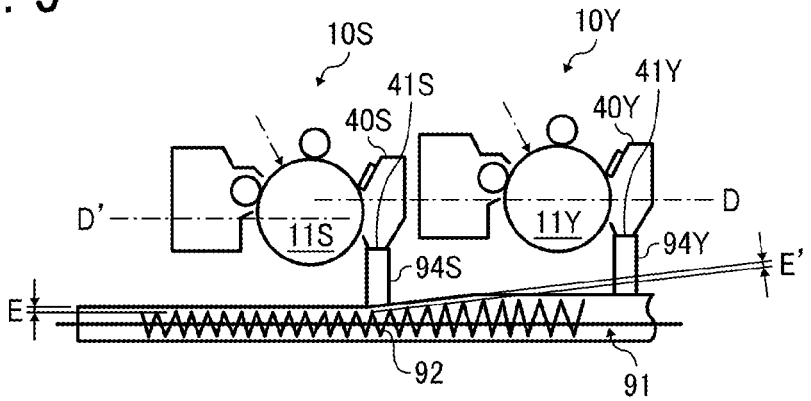
FIG. 9 illustrates a gap between the conveying screw and an inner wall of the common conveyance channel that is different between the tapered portion and a linear portion of the common conveyance channel in the configuration shown in FIG. 8.

Specifically, as shown in FIG. 8, the image forming units 10Y, 10M, 10C, and 10K are at a height D, and the image forming unit 10S is at a height D' lower (closer to the intermediate transfer belt 61) than the height D by about 1 mm to 5 mm, for example. If the image forming unit 10S is at the height D similarly to other four image forming units 10, it is difficult to secure a sufficient distance between the photoreceptor 11Y and the intermediate transfer belt 61 in special image formation. Therefore, the image forming unit 10S is at the height different from that of other image forming units 10.

In this configuration, as described above, the cleaning unit 40S of the image forming unit 10S is closer to the common conveying pipe 91 than the cleaning units 40Y, 40M, 40C, and 40K of the image forming units 10Y, 10M, 10C, and 10K. In this case, if the common conveying pipe 91 is uniform in shape between a portion corresponding to the cleaning unit 40S and a portion corresponding to other four cleaning units 40, the relative position between the toner outlet 41 of the cleaning unit 40 and a toner inlet 99 provided to the common conveying pipe 91 to which the communicating pipe 94 is connected are inconsistent between the cleaning unit 40S and other cleaning units 40. Therefore, the communicating pipe 94 connecting together the toner outlet 41 of the cleaning unit 40 and the toner inlet 99 of the common conveying pipe 91 is not identical in shape and length between the cleaning unit 40S and other four cleaning units 40. Consequently, the components such as the conveying pipe, defining the communicating pipe 94 and the plastic sheet 102 provided therein are not common between special toner and other four toners. This can increase cost as well as the risk of error in installing these components.

By contrast, the common conveying pipe 91 may be bent or curved between the portion connected to the communicating pipe 94S to the portion connected to other four communicating pipes 94 so that the relative positions of the toner outlet 41 of the cleaning unit 40 and the toner inlet 99 of the common conveying pipe 91 can be identical among the five toners. In this case, the components of the communicating pipes 94 and the crosslinking preventer (such as the plastic sheet 102) can be common among the five toners. In this case, however, the position of rotation axis of the conveying screw 92 provided in the common conveying pipe 91 is different between the portion connected to the communicating pipe 94S and the portion connected to other four communicating pipes 94. This can increase complexity such as dividing the conveying screw 92 into multiple screws portions and driving the multiple screw portions respectively by different driving mechanisms, and thus increase the cost.

In view of the foregoing, the common conveying pipe 91 is shaped to equalize the relative positions of the toner outlet 41 of the cleaning unit 40 and the toner inlet 99 of the common conveying pipe 91 between the portion connected to the communicating pipe 94S and the portion connected to other communicating pipes 94 while keeping the position of the rotation axis of the conveying screw 92 inside the common conveying pipe 91 identical or similar. Specifically, by varying a diameter of the common conveying pipe 91, serving as the tubular common conveyance channel member, between the portion connected to the communicating pipe 94S and the portion connected to other communicating pipes 94, the relative positions of the toner outlet 41 of the cleaning unit 40 and the toner inlet 99 of the common conveying pipe 91 are made identical or similar.

With this configuration, the rotation axis of the conveying screw 92 can be at an identical or similar position in any portion, and accordingly the conveying screw 92 can be constructed of a single screw to transport waste toner throughout the common conveying pipe 91. Additionally, since the relative positions of the toner outlet 41 of the cleaning unit 40 and the toner inlet 99 of the common conveying pipe 91 can coincide among the respective cleaning units 40, the components relating to the cleaning units 40, such as the communicating pipes 94, the crosslinking preventers, and the like, can be common, thus inhibiting increases in cost and assembling error.

It is to be noted that it is advantageous, in reducing loss in conveyance of waste toner by the conveying screw 92, that the gap between the outer end of the screw blade 92C of the conveying screw 92 and the inner wall of the common conveying pipe 91 (i.e., an inner face of the common conveyance channel) is smaller. Accordingly, in the present embodiment, the screw blade 92C of the conveying screw 92 is different in outer diameter between the portion connected to the communicating pipe 94S and the portion connected to other four communicating pipes 94 although the axis thereof is identical or similar. This configuration can reduce the gap between the outer end of the screw blade 92C of the conveying screw 92 and the inner wall of the common conveying pipe 91.

Additionally, as shown in FIG. 8, in the present embodiment, the common conveying pipe 91 includes a tapered portion 91B (i.e., a connecting portion) between the portions different in diameter of the common conveying pipe 91, that is, between the portion connected to the communicating pipe 94S and the portion connected to the communicating pipe 94Y. Accordingly, corresponding to the tapered portion 91B, the conveying screw 92 includes a portion 92D where the outer diameter of the screw blade 92C progressively changes to confirm to the inner wall of the tapered portion 91B of the common conveying pipe 91. This configuration can reduce loss in conveyance in the tapered portion 91B of the common conveying pipe 91.

However, considering dimensional variations in the axial direction of the conveying screw 92, it is preferred that a gap E' between the screw blade 92C of the conveying screw 92 and the inner wall of the tapered portion 91B of the common conveying pipe 91 be greater than a gap E in a linear portion of the common conveying pipe 91. This configuration can reliably inhibit contact between the screw blade 92C of the conveying screw 92 and the tapered portion 91B of the common conveying pipe 91 although some loss in conveyance can arise in the tapered portion 91B.

Additionally, since loss in conveyance can arise in the tapered portion 91B of the common conveying pipe 91, it is preferable that the tapered portion 91B does not extend into the portion connected to the communicating pipe 94S and the portion where the cleaning unit 40Y is connected. To those portions, waste toner is successively supplied from the communicating pipes 94. If the waste toner in that portion is not moved away promptly, the waste toner accumulates there and can result in crosslinking. Therefore, it is advantageous to dispose the tapered portion 91B, which may cause loss in conveyance, between the portion connected to the communicating pipe 94S and the portion connected to the communicating pipe 94Y in inhibiting crosslinking of toner in those portions.

It is to be noted that, alternatively, the connecting portion between the portion connected to the communicating pipe 94S and the portion connected to the communicating pipe 94Y may be stepped.

Figure 10:
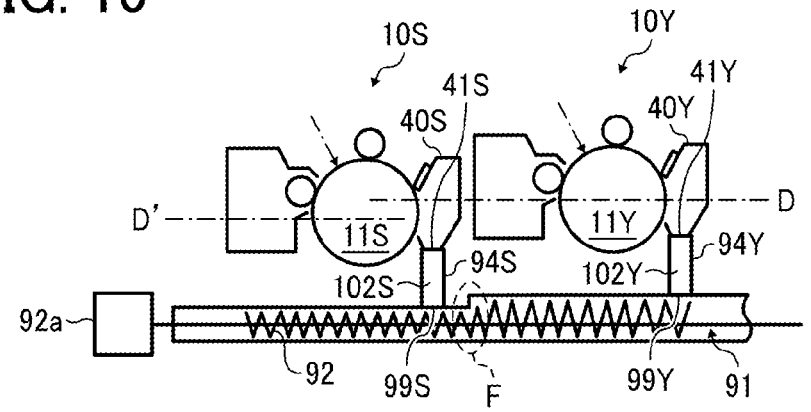
FIG. 10 is a schematic view according to an embodiment, in which the common conveyance channel is stepped between the portion where the communicating channel for special toner is connected and the portion where the communicating channels for other color toners are connected.

In the configuration shown in FIG. 10, the common conveying pipe 91 includes a stepped portion F disposed between the toner inlet 99S connected to the communicating pipe 94S and the toner inlet 99Y connected to the communicating pipe 94Y.

In this case, due to dimensional variations in the axial direction of the conveying screw 92, an end of a large diameter portion of the conveying screw 92 on the side of the communicating pipe 94Y may contact the stepped portion F. Accordingly, it is preferable that a relatively large margin is secured between the stepped portion F and the large diameter portion. In this case, a small diameter portion of the conveying screw 92 on the side of the communicating pipe 94S is positioned in the portion with the margin, and the gap E between the inner wall of the common conveying pipe 91 and the screw blade 92C of the conveying screw 92 is greater, thus increasing loss in conveyance. In this regard, the tapered portion 91B is more advantageous as the connecting portion between the portion connected to the communicating pipe 94S and the portion connected to the communicating pipe 94Y.

Additionally, the small diameter portion of the conveying screw 92 corresponding to the communicating pipe 94S has greater conveyance capability than the large diameter portion corresponding to the communicating pipes 94Y, 94M, 94C, and 94K. In the present embodiment, the small diameter portion of the conveying screw 92 transports waste toner discharged from the cleaning unit 40S only, and thus the amount of waste toner transported is smaller. Accordingly, generally, the conveyance capability is not affected even if the diameter of the conveying screw 92 is reduced in the portion connected to the communicating pipe 94S to achieve commonality of the communicating channels.

However, in a case where the waste toner transported by the small diameter portion of the conveying screw 92 is less easily transported (e.g., fluidity is lower), there is a risk that the conveyance capability of the smaller diameter portion is insufficient. In particular, in the present embodiment, the small diameter portion of the conveying screw 92 transports not standard color toners (yellow, cyan, magenta, and black toners) but special toner such as transparent toner to make the image glossy, and the fluidity thereof may be lower depending on the toner type. When the image forming unit 10S forms a toner image greater in image area ratio, the amount of waste toner increases accordingly. Then, the risk of insufficient conveyance capability can increase.

In such a case, it is preferable to provide a conveyance controller, such as the controller 110 of the image forming apparatus 1, to control a waste toner conveyance according to the image area ratio of the toner image formed using special toner to be transported by the small diameter portion. For example, the controller 110 may input image area data of the image formed by the image forming unit 10S to the conveyance controller. Then, according to the image area data, the conveyance controller may increase the rotation velocity of the driving motor 92*a* when the image area is greater than a threshold. Alternatively, the conveyance controller may be a part of the controller 110.

(First Variation)

Next, descriptions are given below of a first variation of the waste-toner conveyance device according to the above-described embodiment.

In the above-described embodiment, since the exit of the common conveying pipe 91 is positioned on the first end side thereof, the conveying screw 92 is required to transport waste toner discharged from the five cleaning units 40 of the respective image forming units 10. Accordingly, relatively large conveyance capability is secured by increasing the screw blade 92C, increasing the rotation velocity of the rotation shaft 92B, or the like.

Figure 11:
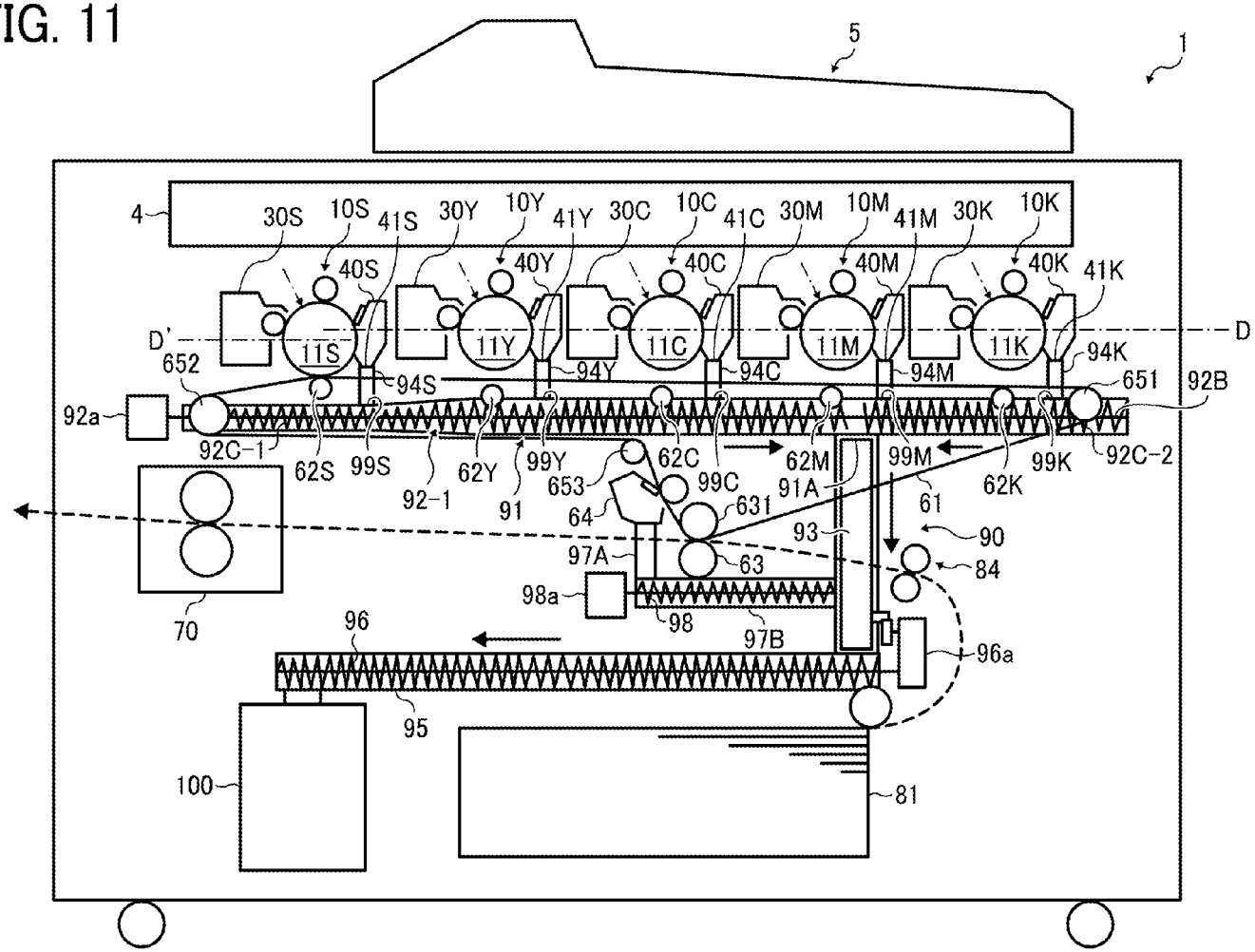
FIG. 11 is a schematic diagram illustrating a waste-toner conveyance device according to a first variation.

FIG. 11 is a schematic diagram illustrating a waste-toner conveyance device according to the first variation. In FIG. 11, reference character 91A represents the exit of the common conveying pipe 91.

In the configuration shown in FIG. 11, the exit 91A of the common conveying pipe 91 is positioned between a portion connected to the communicating pipe 94M for magenta toner and a portion connected to the communicating pipe 94C for cyan toner. A conveying screw 92-1 in the common conveying pipe 91 includes screw blade portions 92C-1 and 92C-2 different in winding directions so that the waste toner inside the common conveying pipe 91 is transported in the opposite directions to the exit 91A from both sides. Specifically, in FIG. 11, the screw blade portion 92C-1 on the left of the exit 91A spirals in a direction to transport waste toner from the left to the right, and the screw blade portion 92C-2 on the right of the exit 91A spirals in the opposite direction to transport waste toner from the right to the left. With this configuration, by rotating the conveying screw 92-1 in a predetermined direction, the waste toner inside the common conveying pipe 91 can be transported to the exit 91A positioned midway through the common conveying pipe 91.

Moreover, since the screw blade portion 92C-1 on the left transports the waste toner discharged from only the three cleaning units 40S, 40Y, and 40M, the required conveyance capability can be smaller. Similarly, since the screw blade portion 92C-2 on the right transports the waste toner discharged from only the two cleaning units 40C and 40K, the required conveyance capability can be smaller. Thus, the conveyance capability of the conveying screw 92-1 can be smaller than that of the conveying screw 92 in the above-described embodiment, and thus reducing the size of the screw blade 92C, rotation velocity, or the like.

(Second Variation)

Next, descriptions are given below of a second variation of the waste-toner conveyance device according to the above-described embodiment.

Figure 12:
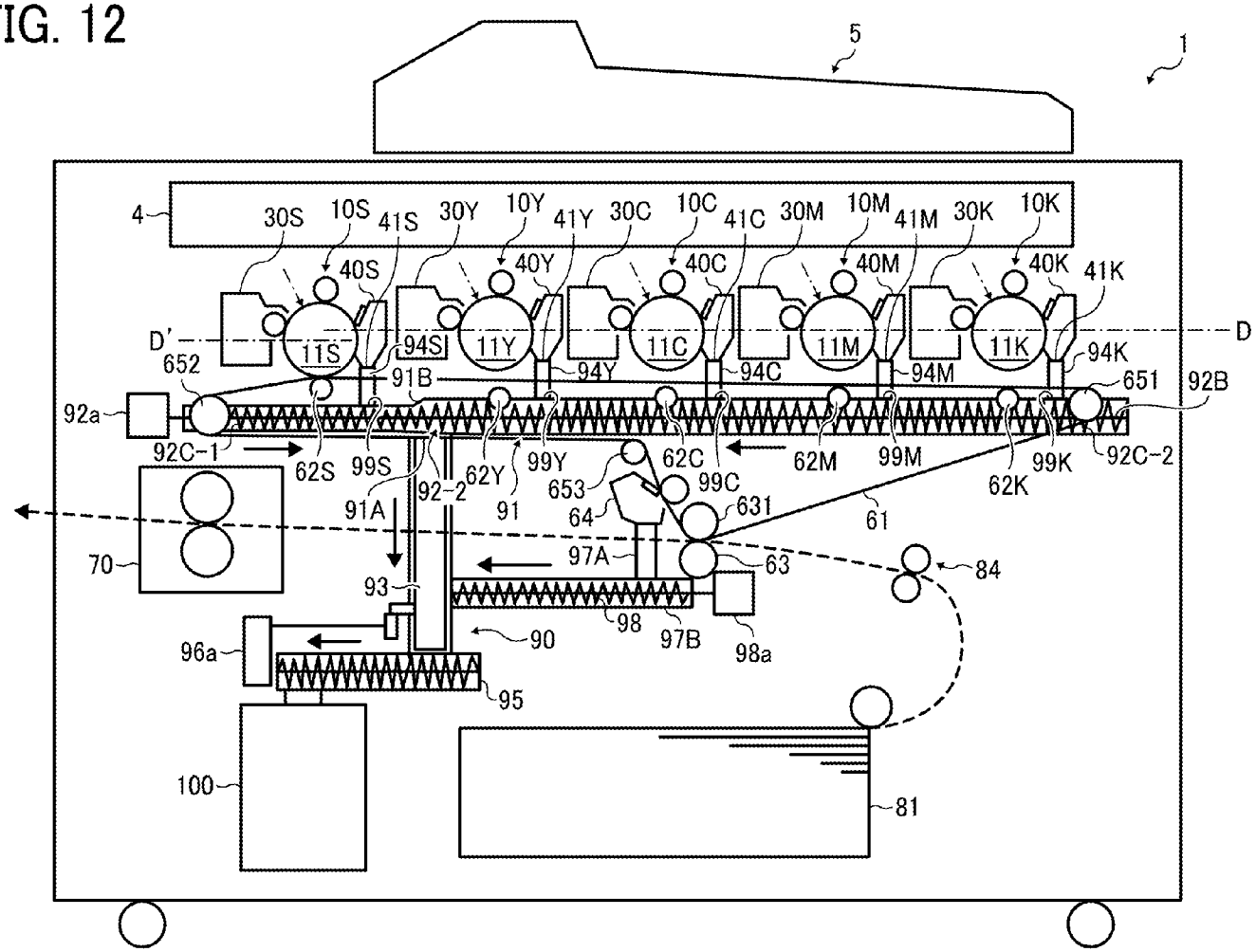
FIG. 12 is a schematic diagram illustrating a waste-toner conveyance device according to a second variation.

FIG. 12 is a schematic diagram illustrating a waste-toner conveyance device according to the second variation.

Similarly to the conveying screw 92-1 in the above-described first variation, in the second variation, a conveying screw 92-2 includes screw blade portions 92C-1 and 92C-2 different in winding directions to transport waste toner to the exit 91A positioned midway through the common conveying pipe 91. Accordingly, this configuration can reduce the size of the screw blade 92C, rotation velocity, or the like.

Further, as shown in FIG. 12, the exit 91A is positioned in the connecting portion between the portions different in diameter of the common conveying pipe 91 (i.e., the conveying pipe), that is, between the portion connected to the communicating pipe 94S and the portion connected to the communicating pipe 94Y. Although loss in conveyance can arise in the portion connecting together the large diameter portion and the small diameter portion of the common conveying pipe 91 as described above, this inconvenience can be solved by disposing the exit 91A in that portion. Accordingly, this arrangement can eliminate the necessity of providing the tapered portion 91B or the portion 92D where the outer diameter of the screw blade 92C progressively changes described above, thus simplifying the structure.

According to the above-described embodiment and the variations thereof, even in a tandem image forming apparatus in which the distance between the toner outlet of the cleaning unit of the image forming unit and the rotation axis of the rotatable conveying member provided in the common conveyance channel differs among the multiple image forming units, commonality can be achieved in the communicating channels that connect the respective toner outlets to the common conveyance channel.

The various aspects of the present specification can attain specific effects as follows.

(Aspect A)

Aspect A concerns a waste-toner conveyance device such as the waste-toner conveyance device 90 provided in an image forming apparatus that includes multiple image forming units, such as the image forming units 10, arranged in a direction in which a transfer medium, such as the intermediate transfer belt 61, moves, and the image forming units 10 include latent image bearers, such as the photoreceptors 11, and cleaning units, respectively. The image forming apparatus transfers toner images from surfaces of the respective latent image bearers onto the transfer medium and collects waste toner from the surfaces of the respective latent image bearers. The waste-toner conveyance device transports the waste toner discharged from toner outlets (such as the toner outlets 41) in the cleaning units to a common conveyance channel, disposed in a direction in which the image forming units are arranged, through communicating channels (such as the communicating pipes 94) connecting the respective toner outlets 41 of the cleaning units to toner inlets (such as the toner inlets 99) of the common conveyance channel.

The waste-toner conveyance device includes a rotatable conveying member, such as the conveying screw 92, to transport the waste toner inside the common conveyance channel linearly along a rotation axis of the conveying screw 92 to a waste-toner container. In the image forming apparatus, a distance between the toner outlet 41 of the cleaning unit and the rotation axis of the rotatable conveying member differs among the multiple image forming units. The common conveying pipe 91 is shaped to equalize relative positions of the toner outlet 41 of the cleaning unit 40 and the toner inlet 99 of the common conveying pipe 91, to which the communicating pipe 94 is connected, among the multiple image forming units, and the communicating pipes 94 are identical or similar in shape or structure.

According to aspect A, the distance between the toner outlet 41 of the cleaning unit and the rotation axis of the rotatable conveying member in the common conveyance channel differs among the multiple image forming units. However, the relative positions of the toner outlet 41 of the cleaning unit 40 and the toner inlet 99 of the common conveying pipe 91 is identical or similar among the respective image forming units. Accordingly, commonality of the communicating channels can be achieved.

(Aspect B)

In aspect A, a tubular member, such as the conveying pipe, defines the common conveyance channel, and the tubular member is different in diameter to equalize the position of the toner inlet 99 relative to the corresponding toner outlet 41 of the cleaning unit 40 among the multiple image forming units.

According to this aspect, commonality of the communicating channels can be achieved with a simple configuration.

(Aspect C)

In aspect B, the rotatable conveying member includes a screw, and an outer end of the screw in a diameter direction thereof is disposed across a gap from an inner face of the common conveyance channel defined by the tubular member. Further, an outer diameter of the screw differs corresponding to the difference in diameter of the tubular member defining the common conveyance channel.

With this configuration, loss in conveyance can be reduced, thus enhancing the conveyance capability, in any of portions of the tubular member different in diameter.

(Aspect D)

The configuration accordingly to aspect C further includes a conveyance controller to control a conveyance velocity at which the small screw portion transports the waste toner according to an image area ratio of the toner image formed by the image forming unit (e.g., the image forming unit 10S) including the cleaning unit (e.g., the cleaning unit 40S) that discharges the waste toner transported by the small screw portion.

This configuration can inhibit waste toner from remaining in the communicating channel and resulting in crosslinking even when a large amount of waste toner lower in fluidity is transported via the communication channel to the common conveyance channel.

(Aspect E)

In any of aspect B through D, in the common conveyance channel, a portion connecting together the portions different in diameter from each other is tapered.

With this configuration, waste toner can be transported smoothly in the portion connecting together the portions different in diameter.

(Aspect F)

In any of aspects B through D, in the common conveyance channel, an exit for the waste toner transported through the common conveyance channel is positioned between the portions different in diameter, and the conveying member is configured to transport the waste toner in the common conveyance channel in the opposite directions to the exit.

With this configuration, as described in the second variation, compared with the configuration in which the exit is at one end of the common conveyance channel, the conveyance capability required of the conveying member can be reduced. Thus, this configuration can reduce the size of the conveying member, the rotational velocity thereof, and the like. In addition, disposing the exit in the portion connecting together the portions different in diameter is advantageous in resolving loss in conveyance in that portion. Accordingly, this configuration can obviate the necessity of providing a structure to alleviate the loss, thereby simplifying the structure.

(Aspect G)

In any of aspect A through E, in the common conveyance channel, an exit for the waste toner transported through the common conveyance channel is positioned between adjacent two toner inlets, and the conveying member is configured to transport the waste toner in the common conveyance channel in the opposite directions to the exit.

With this configuration, as described in the first variation, compared with the configuration in which the exit is at one end of the common conveyance channel, the conveyance capability required of the conveying member can be reduced. Thus, this configuration can reduce the size of the conveying member, the rotational velocity thereof, and the like.

(Aspect H)

Aspect H concerns an image forming apparatus that includes multiple image forming units each including latent image bearers to bear toner images and cleaning units to collect waste toner from surfaces of the latent image bearers; a waste-toner conveyance device to collect waste toner from surfaces of the latent image bearer, and a waste-toner container. The waste-toner conveyance device includes a common conveyance channel disposed in a direction in which the image forming units are arranged and provided with toner inlets to receive the waste toner from respective toner outlets of the cleaning units, communicating channels respectively disposed between the toner outlets to the toner inlets of the common conveyance channel, and a rotatable conveying member to transport the waste toner inside the common conveyance channel linearly along a rotation axis thereof. A distance between the toner outlet of the cleaning unit and the rotation axis of the rotatable conveying member differs among the multiple image forming units, and the waste-toner conveyance device according to any one of aspects A through G is used.

According to this aspect, commonality of the communicating channels can be achieved in a configuration in which the distance between the toner outlet of the cleaning unit and the rotation axis of the rotatable conveying member in the common conveyance channel differs among the multiple image forming units.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

multiple image forming units respectively including latent image bearers to bear toner images and cleaning units to collect waste toner from surfaces of the latent image bearers;

a waste-toner container to contain the waste toner discharged from the cleaning units; and a waste-toner conveyance device to transport the waste toner to the waste-toner container, the waste-toner conveyance device including:

a common conveyance channel member disposed in a direction in which the image forming units are arranged, the common conveyance channel member provided with toner inlets to receive the waste toner from respective toner outlets of the cleaning units, communicating channel members respectively disposed between the toner outlets of the cleaning units and the toner inlets of the common conveyance channel member, the communicating channel members identical in structure, and a rotatable conveying member to transport the waste toner inside the common conveyance channel member linearly along a rotation axis of the conveying member, wherein a distance from each of the toner outlets of the cleaning units to the rotation axis of the conveying member differs among the multiple image forming units, and the common conveyance channel member is shaped to equalize relative positions of each of the toner outlets of the cleaning unit and a corresponding one of the toner inlets of the common conveyance channel member among the multiple image forming units.

2. The image forming apparatus according to claim 1, wherein the common conveyance channel member is tubular, and a diameter of the common conveyance channel member is different among portions corresponding to the toner inlets to equalize the relative positions of each of the toner outlets of the cleaning units and the corresponding one of the toner inlets of the common conveyance channel member among the multiple image forming units.

3. The image forming apparatus according to claim 2, wherein the conveying member comprises a screw, an outer end of the screw in a diameter direction thereof is disposed across a gap from an inner wall of the common conveyance channel member, and the screw includes a small screw portion and a large screw portion larger in outer diameter than the small screw portion, corresponding to a difference in diameter of the common conveyance channel member.

4. The image forming apparatus according to claim 3, further comprising a conveyance controller to control a conveyance velocity at which the small screw portion transports the waste toner, wherein the conveyance controller controls the conveyance velocity according to an image area ratio of the toner image formed by one of the image forming units that discharges the waste toner transported by the small screw portion.

5. The image forming apparatus according to claim 2, wherein the common conveyance channel member comprises a tapered connecting portion to connect together the portions corresponding to the toner inlets and different in diameter.

6. The image forming apparatus according to claim 2, wherein an exit of the common conveyance channel member through which the waste toner exits the common conveyance channel member is positioned in a connecting portion connecting together the portions corresponding to the toner inlets and different in diameter, and the conveying member is shaped to transport the waste toner in the common conveyance channel member in opposite directions to the exit.

7. The image forming apparatus according to claim 1, an exit of the common conveyance channel member through which the waste toner exits the common conveyance channel member is positioned between adjacent two of the toner inlets, and the conveying member is shaped to transport the waste toner in the common conveyance channel member in opposite directions to the exit.

8. A waste-toner conveyance device installable in an image forming apparatus including multiple image forming units, the waste-toner conveyance device comprising:

a common conveyance channel member disposed in a direction in which the image forming units are arranged, the common conveyance channel member provided with toner inlets to receive the waste toner from respective toner outlets of the cleaning units, communicating channel members identical in structure and respectively disposed between the toner outlets and the toner inlets of the common conveyance channel member; and a rotatable conveying member to transport the waste toner inside the common conveyance channel member linearly along a rotation axis thereof, wherein a distance from each of the toner outlets of the cleaning units to the rotation axis of the conveying member differs among the multiple image forming units, and the common conveyance channel member is shaped to equalize relative positions of each of the toner outlets of the cleaning unit and a corresponding one of the toner inlets of the common conveyance channel member among the multiple image forming units.

* * * * *